US009289972B2

(12) United States Patent
Aronhime et al.

(10) Patent No.: US 9,289,972 B2
(45) Date of Patent: Mar. 22, 2016

(54) IMPRESSION MEDIUMS, PRINTING SYSTEM HAVING IMPRESSION MEDIUM, AND METHOD THEREOF

(75) Inventors: Marc Aronhime, Rehovot (IL); Tamir Weinstein, Rehovot (IL); Shai Druckman, Givatayim (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/352,256

(22) PCT Filed: Oct. 28, 2011

(86) PCT No.: PCT/EP2011/068978

§ 371 (c)(1),
(2), (4) Date: Apr. 16, 2014

(87) PCT Pub. No.: WO2013/060379

PCT Pub. Date: May 2, 2013

(65) Prior Publication Data

US 2014/0261036 A1 Sep. 18, 2014

(51) Int. Cl.

| | |
|---|---|
| ***B41F 13/18*** | (2006.01) |
| ***B41F 23/00*** | (2006.01) |
| ***G03G 15/16*** | (2006.01) |
| *B41N 10/00* | (2006.01) |

(52) U.S. Cl.

CPC ..... *B41F 23/00* (2013.01); *G03G 15/1685* (2013.01); *B41F 13/18* (2013.01); *B41N 10/00* (2013.01); *G03G 2215/00683* (2013.01); *G03G 2215/1619* (2013.01); *Y10T 428/24942* (2015.01)

(58) Field of Classification Search

None

See application file for complete search history.

(56) References Cited

U.S. PATENT DOCUMENTS

| | | | | |
|---|---|---|---|---|
| 5,026,602 | A * | 6/1991 | Kitagawa | 428/336 |
| 5,429,872 | A | 7/1995 | Nakamura et al. | |
| 5,797,827 | A * | 8/1998 | Sondergeld | 492/37 |
| 2002/0058194 | A1 | 5/2002 | Williams et al. | |
| 2008/0101819 | A1 | 5/2008 | Nakamura et al. | |
| 2010/0212523 | A1 * | 8/2010 | Sakurai et al. | 101/407.1 |
| 2011/0045305 | A1 | 2/2011 | Gilmartin et al. | |
| 2011/0176841 | A1 | 7/2011 | Jennings et al. | |

FOREIGN PATENT DOCUMENTS

| | | | |
|---|---|---|---|
| JP | 2002006718 | A | 1/2002 |
| JP | 2002187141 | A | 7/2002 |
| JP | 2008268675 | A | 11/2008 |
| WO | WO-9961958 | A1 | 12/1999 |
| WO | WO-2011021061 | A1 | 2/2011 |

OTHER PUBLICATIONS

PCT Search Report/Written Opinion ~ Application No. PCT/EP2011/068978 dated Sep. 19, 2012 ~ 20 pages.

* cited by examiner

*Primary Examiner* — Jill Culler

(74) *Attorney, Agent, or Firm* — HP Inc. Patent Department

(57) ABSTRACT

An impression medium usable with an impression member of a printing system is disclosed. The impression medium includes a top layer and a backing layer disposed between the top layer and the impression member.

17 Claims, 6 Drawing Sheets

IMPRESSION MEDIUMS, PRINTING SYSTEM HAVING IMPRESSION MEDIUM, AND METHOD THEREOF

BACKGROUND

Printing systems such as a liquid electrophotography printing system may form a composite image on a substrate. The composite image may be a multicolor image formed by superimposing respective print separations with respect to each other. Each print separation may correspond to a different basic color such that the respective print separations may be coordinated with and aligned to each other. The substrate may contact an impression medium on an impression member to be transported to receive the respective print separations.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
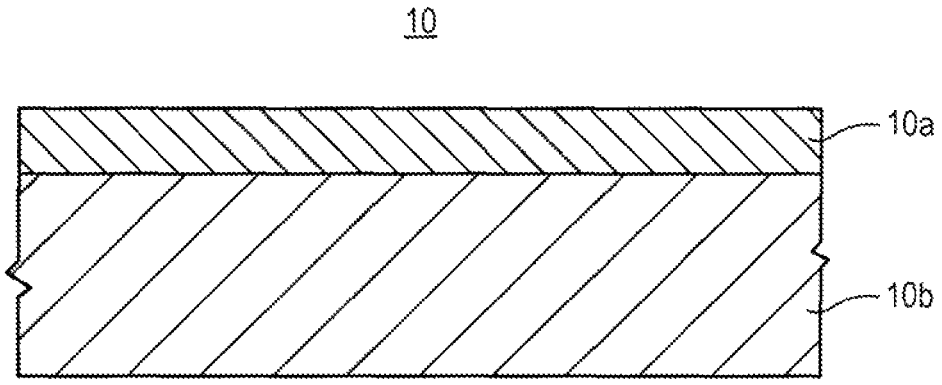
FIG. 1 is a cross-sectional view illustrating a portion of an impression medium according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Printing systems such as a liquid electrophotography (LEP) printing system may form a composite image on a substrate. The composite image may be a multicolor image formed by superimposing respective print separations with respect to each other. Each print separation may correspond to a different basic color such that the respective print separations may be coordinated with and aligned to each other. The substrate may contact an impression medium on an impression member to be transported to receive the respective print separations. The impression medium, for example, may be held onto the impression member to minimize damage and/or image defects in response to a potential malfunctioning of the printing system.

If there is a substrate misfeed or other malfunction, then the fluid including ink such as toner may be transferred from an image transfer blanket of an intermediate transfer member (ITM) directly to the impression medium to reduce fluid including ink such as toner from remaining on and/or damaging the image transfer blanket. Misalignment, however, may occur between the respective print separations formed on the substrate to form the corresponding composite image resulting in misregistration. Misregistration may be in a form of vertical misregistration in which misalignment of the respective print separations occurs along a length of the substrate. That is, vertical misregistration may be the misalignment of the respective print separations due to an unintended offset of the respective print separations on the substrate in a substrate transport direction.

Such misregistration may take place, for example, during a transfer of a respective print separation from the image transfer blanket of the ITM to the substrate due to several forces acting on the substrate such as friction (e.g., slip) toward the impression medium and tackiness toward the image transfer blanket of the ITM. Accordingly, the substrate may accelerate through a contact nip between the impression member and the ITM potentially resulting in misregistration. Additionally, the impression medium may be subjected to elongation. Consequently, the substrate may undesirably move with respect to the impression medium which may result in misregistration. Additionally, such misregistration may appear more pronounced in a duplex printing mode in which successive duplex pages may differ greatly in print coverage on the respective simplex sides.

In examples, impression mediums, a printing system, and a method to suppress misregistration are disclosed. For example, an impression medium may include, amongst other things, a top layer to receive a substrate in which the top layer includes a high coefficient of static friction (COF) with respect to the substrate in a range of 0.7 to 2 at at least one temperature in a range of 50° C. to 60° C. For example, an impression member may have a temperature in a range of 50° C. to 60° C. during normal operation. The top layer of the impression medium of the impression member may reduce undesirable movement of the substrate with respect to the impression member. Thus, misregistration between print separations of a composite image formed on a substrate may be reduced.

Figure 3:
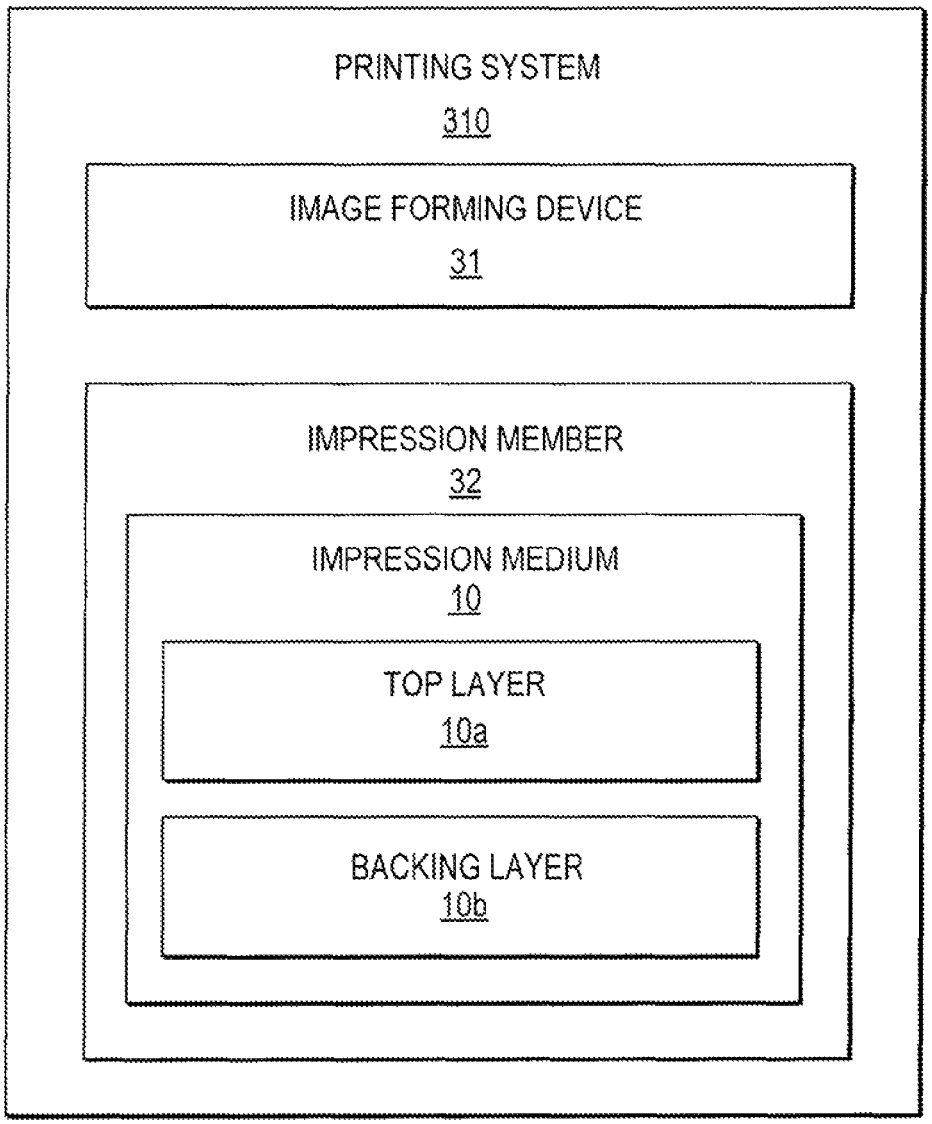
FIG. 3 is a block diagram illustrating a printing system according to an example.

FIG. 1 is a cross-sectional view illustrating a portion of an impression medium according to an example. Referring to FIG. 1, in some examples, an impression medium may be usable with an impression member of a printing system. The impression medium 10 may include a top layer 10*a* and a backing layer 10*b*). The top layer 10*a* may receive a substrate S (FIG. 4) thereon. The top layer 10*a* may include a high COF with respect to the substrate S in a range of 0.7 to 2 at at least one temperature in a range of 50° C. to 60° C. That is, the COF between respective surfaces of the top layer 10*a* and the respective substrate S in contact with each other may be in a range of about 0.7 to about 2. In comparison, COF of many materials are in a range of about 0.3 to about 0.6. Silicone rubber, for example, may have a COF of about 1. The backing layer 10*b* may be disposed between and in contact with the top layer 10*a* and the impression member 32 (FIG. 3).

Referring to FIG. 1, in some examples, the top layer 10*a* may include at least one of polyurethane, acrylic rubber, natural rubber, styrene butadiene rubber, silicon rubber, ethylene acrylic acid copolymer, polyethyleneimine, amine terminated polyamide, and polyvinyl pyridine. For example, polyurethane may render a high COF to the top layer 10*a*. Additionally, acrylic rubber, natural rubber, styrene butadiene rubber and silicon rubber may also render a high COF to the top layer 10*a*. In some examples, ethylene-acrylic acid copolymer may render a high affinity to fluid including ink such as toner to the top layer 10*a* intended to be transferred to the respective substrate. That is, the respective substrate S contacts the top layer 10*a* and is transported by the impression member 32 to receive print separations thereon.

For example, the top layer 10*a* may receive fluid including ink such as toner from an image transfer blanket 35*a* (FIG. 3) of the ITM 35 (FIG. 3) intended for the respective substrate S due to a misfeed of the substrate S, or the like. Additionally, in some examples, polyethyleneimine, amine terminated polyamides and poly vinyl pyridines may also render an affinity to the respective fluid to the top layer 10*a*. Thus, the back transfer of fluid deposited on the top layer 10*a* to the image transfer blanket 35*a* may be reduced. In some examples, the top layer 10*a* may have a thickness in a range of about 5 to about 30 microns such as a thickness of about 7 to about 17 microns.

Referring to FIG. 1, for example, the top layer 10*a* may include polyurethane and ethylene acrylic acid copolymer. In some examples, a ratio of the polyurethane to the ethylene acrylic acid copolymer may be about 60 parts to 40 parts. The ethylene-acrylic acid copolymer, for example, may include DigiPrime 4431, Digiprime 4450, Michem-Prime 4990, and Michem-Prime 4983R from Michelman Co., or the like. In some examples, the top layer 10*a* may include a high COF with respect to the substrate S in the range of 0.7 to 2 at at least one temperature in the range of 50° C. to 60° C. Additionally, the top layer 10*a* may include a high COF with respect to the substrate S in the range of 0.7 to 2 at each temperature in the range of 50° C. to 60° C. Still yet, in some examples, the top layer 10*a* may include a high COF with respect to the substrate S in the range of 0.7 to 2 at a temperature of about 60° C.

Referring to FIG. 1, in some examples, the backing layer 10*b* may include at least one of paper, latex saturated paper, polyethylene terephthalate, and biaxially oriented polypropylene. For example, the paper may be a plain paper such as Gardamatt Art, 300 gsm, available from Cartiere del Garda, Italy. The latex saturated paper may be Hyflex 12 from Fibermark, USA. The impregnation of the paper by latex may provide a tear resistant property to the paper. The backing layer 10*b*, for example, may be a backing sheet. In some examples, the backing layer 10*b* may have a thickness in a range of about 150 to about 350 microns such as a thickness of about 250 to about 300 microns.

Figure 2:
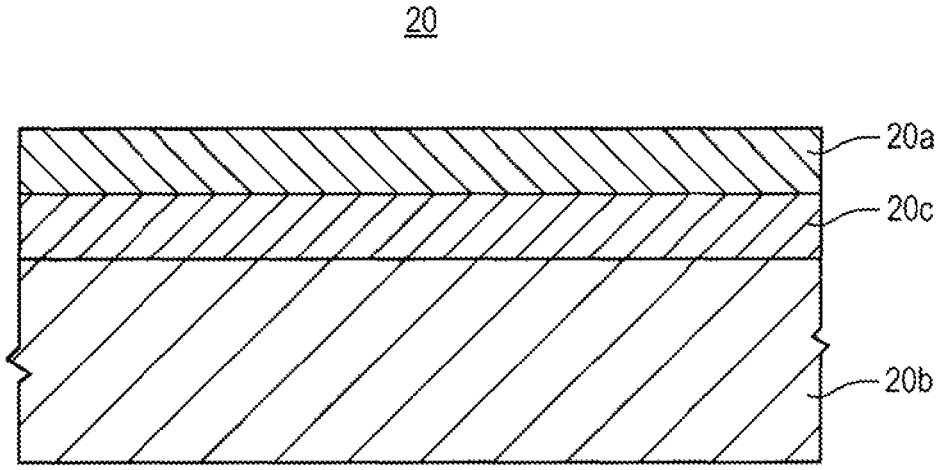
FIG. 2 is a cross-sectional view illustrating a portion of an impression medium according to an example.

FIG. 2 is a cross-sectional view illustrating a portion of an impression medium according to an example. Referring to FIG. 2, in some examples, an impression medium 20 may be usable with an impression member 32 of a printing system 310. The impression medium 20 may include a backing layer 20*b*, a top layer 20*a* and an intermediate layer 20*c* disposed between the backing layer 20*b* and the top layer 20*a*. The backing layer 20*b* may be disposed in contact with the impression member. The intermediate layer 20*c* may be disposed on the backing layer 20*b*. The intermediate layer 20*c* may include polyurethane and an ethylene acrylic acid copolymer having at least one of a grey pigment and a black pigment. The top layer 20*a* may include polyurethane and ethylene acrylic acid copolymer having a ratio of the polyurethane to the ethylene acrylic acid copolymer of about 60 parts to 40 parts. In some examples, each of the top layer 20*a* and the intermediate layer 20*c* may each have a thickness in a range of about 5 to about 30 microns such as a thickness of about 7 to about 17 microns. In some examples, the backing layer 20*b* may have a thickness in a range of about 150 to about 350 microns such as a thickness of about 250 to about 300 microns.

FIG. 3 is a block diagram illustrating a printing system according to an example. Referring to FIG. 3, in examples, the printing system 310 may include an image forming device 31 and an impression member 32. The impression member 32 may include an impression medium 10 having a backing layer 10*b* and a top layer 10*a*, for example, as previously disclosed with respect to the impression medium 10 of FIG. 1. In some examples, the impression member 32 may include an impression medium 20 having a backing layer 20*b*, an intermediate layer 20*c* and a top layer 20*a*, for example, as previously disclosed with respect to the impression medium 20 of FIG. 2. The image forming device 31 may form a latent image and corresponding print separations to be formed on a substrate S to form an image (e.g., composite image). The backing layer 10*b* may be disposed on the impression member 32, The top layer 10*a* may receive a substrate S and be disposed on the backing layer 10*b*. The top layer 10*a* may include a high COF with respect to the substrate S in a range of 0.7 to 2 at at least one temperature in a range of 50° C. to 60° C. Additionally, the top layer 10*a* may include a high COF with respect to the substrate S in the range of 0.7 to 2 at each temperature in the range of 50° C. to 60° C. Still yet, in some examples, the top layer 10*a* may include a high COF with respect to the substrate S in the range of 0.7 to 2 at a temperature of about 60'C.

Figure 4:
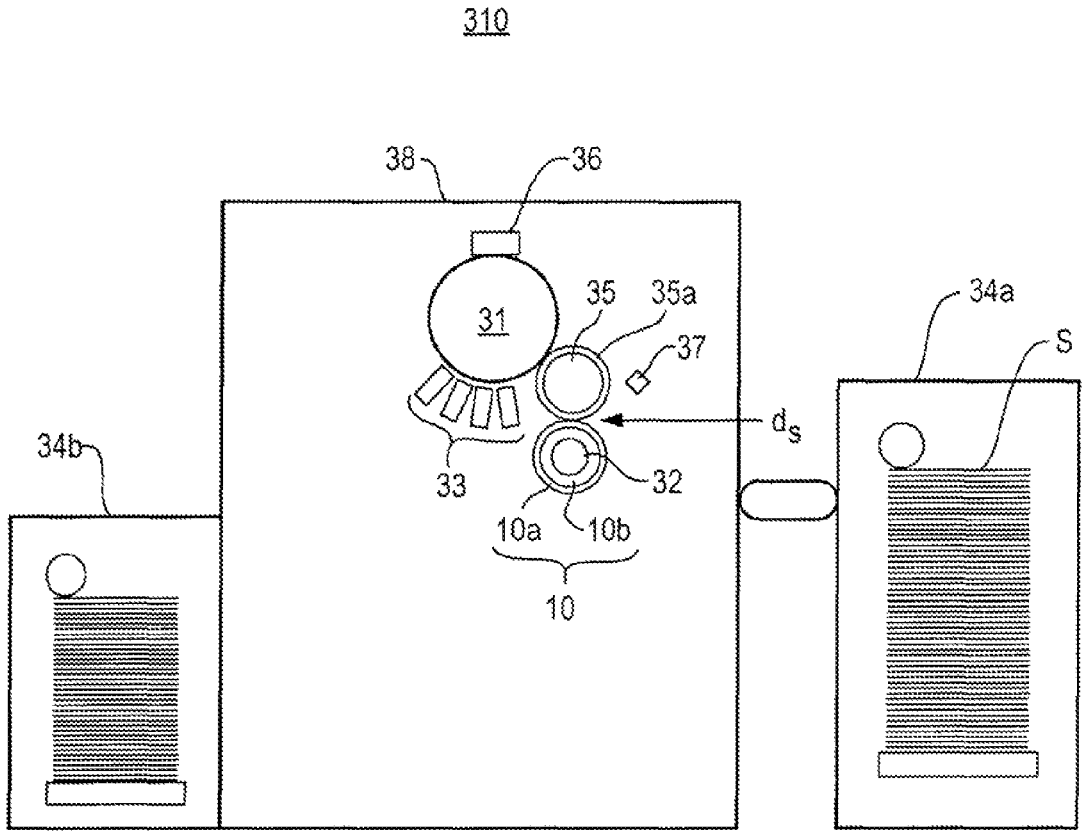
FIG. 4 is a schematic view illustrating the printing system of FIG. 3 according to an example.

FIG. 4 is a schematic view illustrating a printing system according to an example. Referring to FIG. 4, a printing system 310 such as an LEP printing system may include an image forming unit 38 to receive a substrate S from an input unit 34*a*. Subsequently, the image forming unit 38 may output the substrate S to an output unit 34*b*. The image forming unit 38 may include a fluid applicator unit 33 and an image forming device 31 (e.g., photoconductive member) on which images may be formed. The image forming device 31 may be charged with a suitable charger (not illustrated) such as a charge roller. Portions of the outer surface of the image forming device 31 that correspond to features of the image can be selectively discharged by a laser writing unit 36 to form an electrostatic and/or latent image thereon.

In some examples, the fluid applicator unit 33 may include a plurality of BIDs in which each BID may correspond to a respective color ink such as black ink, cyan ink, yellow ink, and magenta ink. The ink may be liquid toner, for example, ElectroInk, trademarked by Hewlett-Packard Company. The fluid applicator unit 33 may apply fluid including ink such as toner to the electrostatic and/or latent image to form a corresponding image on the image forming device 31 to be transferred to the image transfer blanket 35*a* of the ITM 35. For example, a respective print separation corresponding to the image may be sequentially transferred to the image transfer blanket 35*a* of the ITM 35 and, subsequently there from, to the substrate S.

During the transfer of the respective print separation from the image transfer blanket 35*a* to the substrate S, the substrate S may be pinched in a contact nip between the image transfer blanket 35*a* of the ITM 35 and an impression medium 10 (e.g., top layer 10*a*) of an impression member 32. The top layer 10*a* may receive a substrate S and include a high COF with respect to the substrate S in a range of 0.7 to 2 at at least one temperature in a range of 50° C. to 60° C. In some examples, the top layer 10*a* may include a high COF with respect to the substrate S in the range of 0.7 to 2 at each temperature in the range of 50° C. to 60° C. Still yet, in some examples, the top layer 10*a* may include a high COF with respect to the substrate S in the range of 0.7 to 2 at a temperature of about 60° C.

The substrate S may wrap onto the impression medium 10 covering the impression member 32. During the transfer process of the fluid from the image transfer blanket 35*a* of the ITM 35 to the substrate 5, a back side of the substrate S may be in contact with the top layer 10*a* of the impression medium 10. As the substrate S contacts the image transfer blanket 35*a*, the respective print separation may be transferred to the substrate S. To form the composite image, the substrate S may be retained on the impression medium 10 and make multiple contacts with the image transfer blanket 35*a* as it passes through the contact nip there between. Subsequently, the substrate S is removed from the impression member 32 and conveyed to the output unit 34*b*.

Referring to FIG. 4, in some examples, the printing system 310 may also include a sensor unit 37 and the impression medium 10 therein may also include an intermediate layer 20*c* (FIG. 2). The sensor unit 37 may detect a misalignment of the respective substrate S with respect to the impression medium 10 based on a color contrast between the substrate S and the impression medium 10. The sensor unit 37, for example, may be an infrared sensor. The intermediate layer 20*c* may be disposed between the backing layer 10*b* and the top layer 10*a*. That is, the intermediate layer 20*c* may include polyurethane and an ethylene acrylic acid copolymer having at least one of a grey pigment and a black pigment. In some examples, such dark pigments may increase a color contrast, for example, between a white substrate S and the top layer 10*a* of the impression medium 10. Such an increase to the color contrast between a respective substrate S and the top layer 10*a* may increase the detection of misalignment of the respective substrate S with respect to the top layer 10*a* by the sensor unit 37.

Figure 5:
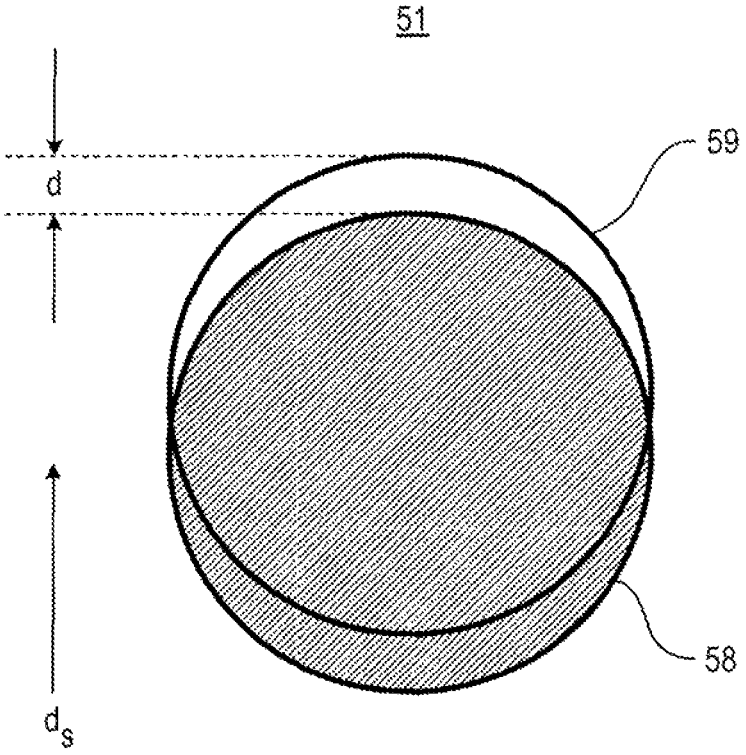
FIG. 5 is a top view illustrating misregistration of a composite image including several print separations formed on a substrate according to an example.

FIG. 5 is a top view illustrating misregistration of a composite image including several print separations formed on a substrate according to an example. Referring to FIG. 5, a composite image 51 is formed on a substrate S by a first print separation 58 and a second print separation 59 with misregistration. That is, the first and second print separations 58 and 59 are misaligned (e.g., unintentionally offset from each other) in a vertical direction (e.g., substrate transport direction $d_s$) by a distance d. Accordingly, the composite image 51 includes vertical misregistration as illustrated in FIG. 5.

Figure 6:
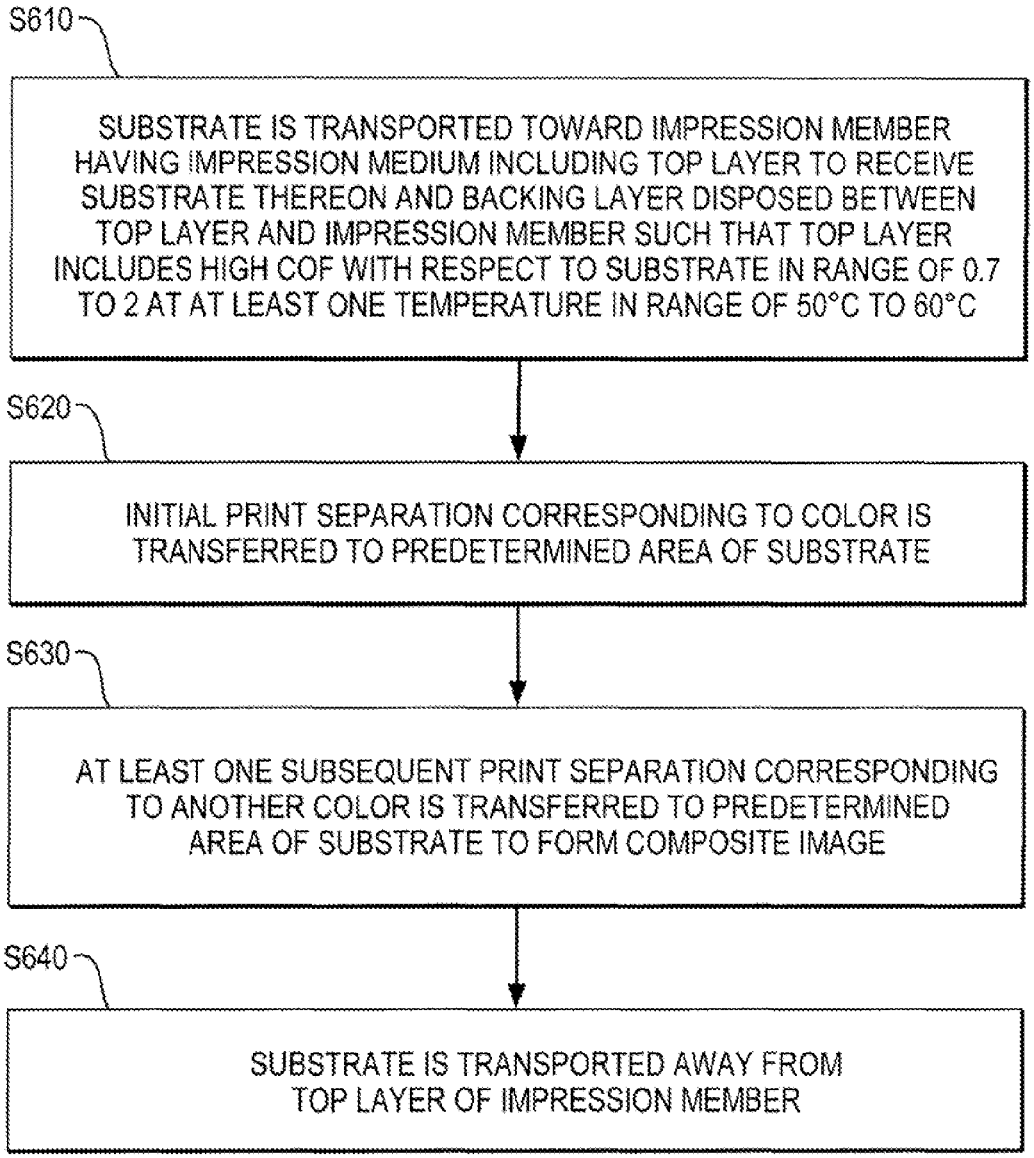
FIG. 6 is a flowchart illustrating a method to suppress misregistration between print separations of a composite image formed by a printing system having an impression member and an impression medium thereon according to an example.

FIG. 6 is a flowchart illustrating a method to suppress misregistration between print separations of a composite image formed by a printing system having an impression member and an impression medium thereon according to an example. Referring to FIG. 6, in block S610, a substrate is transported toward the impression member having the impression medium including a top layer to receive a substrate thereon and a backing layer disposed between the top layer and the impression member such that the top layer includes a high COF with respect to the substrate in a range of 0.7 to 2 at at least one temperature in a range of 50° C. to 60° C. Additionally, the top layer may include a high COF with respect to the substrate in the range of 0.7 to 2 at each temperature in the range of 50° C. to 60° C. Still yet, in some examples, the top layer may include a high COF with respect to the substrate in the range of 0.7 to 2 at a temperature of about 60° C. The top layer, for example, may include polyurethane and an ethylene acrylic acid copolymer such that a ratio of the polyurethane to the ethylene acrylic acid copolymer is about 60 parts to 40 parts.

In block S620, an initial print separation corresponding to a color is transferred to a predetermined area of the substrate. For example, the transferring an initial print separation corresponding to a color on a predetermined area of the substrate may also include forming a first print separation by an image forming device of the printing system, transferring the first print separation to an image transfer blanket of the ITM of the printing system, and transferring the first print separation from the image transfer blanket of the ITM to the predetermined area of the substrate. In block S630, at least one subsequent print separation corresponding to another color is transferred to the predetermined area of the substrate to form the composite image. For example, the transferring at least one subsequent print separation corresponding to another color to the predetermined area of the substrate to form a composite image may also include forming a second print separation on an image forming device of the printing system, transferring the second print separation to an image transfer blanket of the ITM of the printing system, and transferring the second print separation from the ITM to the predetermined area of the substrate. In block S640, the substrate is transported away from the top layer of the impression member.

Figure 7:
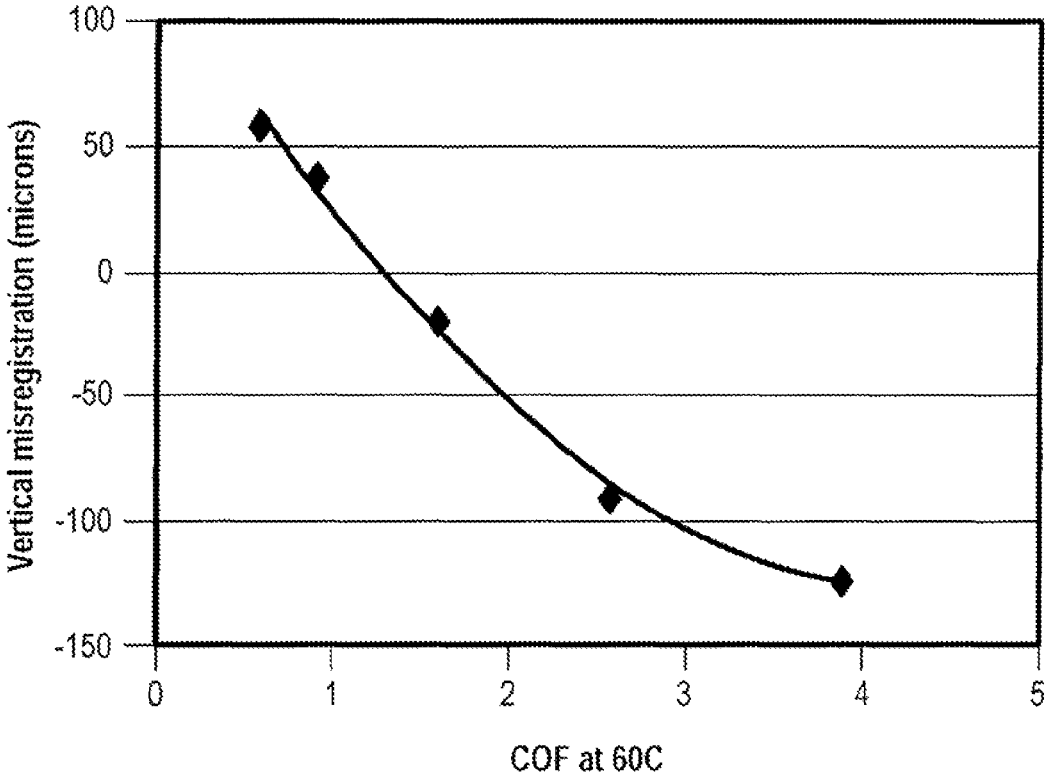
FIG. 7 is a plot diagram illustrating a relationship between misregistration and a coefficient of static friction at 60° C. of a top layer of an impression medium with respect to a substrate according to examples.

FIG. 7 is a plot diagram illustrating a relationship between misregistration (given in microns) and a COF with respect to a substrate at 60° C. of a top layer of an impression medium according to examples. FIG. 7 illustrates, for example, various COFs at a temperature of about 60° C. corresponding to a change in the ratio of polyurethane to DigiPrime 4431(DP) (an ethylene acrylic acid copolymer) of a top layer 10*a* of an impression medium 10 with respect to a substrate S according to an example. The substrate S was a paper identified as Euro Art gloss, 135 gsm, as supplied by Sappi.

Example

1. Preparation of Impression Medium

A backing layer 10*b* was a latex saturated paper, Hyflex 12, from FiberMark Co. (USA). The thickness of the paper was about 12 mil, or 300 microns. On top of the backing layer 10*b*, a top layer 10*b* was applied including a mixture of water based dispersions of polyurethane (PU) such as Reichhold UROTUF L54-MPW-32 elastomer, and various proportions of DigiPrime 4431(DP), supplied by Michelman. The top layer 10*a* was made by using a wire-rod process. DP is based on a copolymer of ethylene acrylic acid and sold as a primer for HP indigo liquid toner by Michelman. The water was dried out by heating the top layer 10*a* in an oven at 120° C. The final thickness of the dry polymers mixture of the top layer 10*a* was 10-16 microns.

2. Results

The impression medium 10 as prepared using the previously disclosed procedure was installed in HP indigo 7000 press and vertical misregistration was measured with results illustrated in FIG. 7. Referring to FIG. 7, the plot corresponds to a case in which successive duplex pages which differ greatly in coverage on the simplex sides are printed (0% coverage versus 100% magenta). The vertical misregistration is plotted, for example, in a form of an amount of misalignment between respective print separations of a corresponding composite image with respect to the COF at 60° C. The measurement of the COF was performed at 60° C. since the temperature of the impression member 32 generally may reach about 60° C. during a printing process at steady state conditions.

The COF was measured by standard laboratory equipment (Thwing Albert Friction Peel Tester). It was measured using a substrate S such as a blank paper (Euro Art gloss, 135 gsm, as supplied by Sappi) applied against the top layer 10*a* of the impression medium 10. The results are listed in column 2 of Table. 1. Measurements were also made using the same paper covered by 100% magenta. The results are listed in column 3 of Table 1.

TABLE 1

COF Results

| PU/DP (Dry weight ratio of polymers in top layer) | COF at 60°C. Blank sheet vs. tested sample | COF at 60°C. Magenta printed sheet vs. tested sample |
|---|---|---|
| No top layer | 0.6 | 0.6 |
| 10/0 | 0.8 | 0.9 |
| 6/4 | 1.5 | 1.6 |
| 5/5 | 2.5 | 2.6 |
| 4/6 | 3.6 | 3.9 |

In some examples, misregistration such as vertical misregistration in a range of −50 microns to 50 microns may be considered visually acceptable on the basis of customer satisfaction tests. Referring to FIG. 7, the top layer 10*a* of the impression medium 10 having a COF range with respect to the substrate S of about 0.7 to 2 at 60° corresponds to misregistration in a range of −50 microns to 50 microns.

It is to be understood that the flowchart of FIG. 6 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be scrambled relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An impression medium usable with an impression member of a printing system, the impression medium comprising:

a top layer to receive a substrate, the top layer having a high coefficient of static friction with respect to the substrate in a range of 0.7 to 2 at at least one temperature in a range of 50° C. to 60° C., wherein the top layer comprises polyurethane and ethylene acrylic acid copolymer; and a backing layer disposed between and in contact with the top layer and the impression member.

2. The impression medium according to claim 1, wherein:

the backing layer comprises at least one of paper, latex saturated paper, polyethylene terephthalate, and bi-axially oriented polypropylene; and the top layer further comprises at least one of polyurethane, acrylic rubber, natural rubber, styrene butadiene rubber, silicon rubber, ethylene acrylic acid copolymer, polyethyleneimine, amine terminated polyamide, and polyvinyl pyridine.

3. The impression medium according to claim 1, wherein a weight ratio of the polyurethane to the ethylene acrylic acid copolymer is about 60 parts to 40 parts.

4. A printing system to suppress misregistration between print separations on a substrate, the printing system comprising:

an image forming device to form a latent image and corresponding print separations to be printed on the substrate to form an image;

an impression member having an impression medium thereon, the impression medium including:

a backing layer disposed on the impression member, and a top layer disposed on the backing layer to receive the substrate, the top layer having a high coefficient of static friction with respect to the substrate in a range of 0.7 to 2 at at least one temperature in a range of 50° C. to 60° C.; and an intermediate layer disposed between the backing layer and the top layer, the intermediate layer including polyurethane and an ethylene acrylic acid copolymer having at least one of a grey pigment or a black pigment.

5. The printing system according to claim 4, wherein the top layer comprises at least one of polyurethane, acrylic rubber, natural rubber, styrene butadiene rubber, silicon rubber, ethylene acrylic acid copolymer, polyethyleneimine, amine terminated polyamide, and polyvinyl pyridine.

6. The printing system according to claim 4, wherein the top layer comprises polyurethane and an ethylene acrylic acid copolymer.

7. The printing system according to claim 6, wherein a we ratio of the polyurethane to the ethylene acrylic acid copolymer is about 60 parts to 40 parts.

8. The printing system according to claim 4, wherein:

the backing layer comprises at least one of paper, latex saturated paper, polyethylene terephthalate, and bi-axially oriented polypropylene; and the top layer comprises at least one of polyurethane, acrylic rubber, natural rubber, styrene butadiene rubber, silicon rubber, ethylene acrylic acid copolymer, polyethyleneimine, amine terminated polyamide, and polyvinyl pyridine.

9. The printing system according to claim 4, further comprising:

a sensor unit to detect a misalignment of the substrate with respect to the impression medium based on a color contrast between the substrate and the impression medium.

10. A method to suppress misregistration between print separations of a composite image formed by a printing system having an impression member and an impression medium thereon, the method comprising:

transporting a substrate toward the impression member having the impression medium including a top layer to receive the substrate thereon and a backing layer thereon such that the top layer includes a high coefficient of static friction with respect to the substrate in a range of 0.7 to 2 at at least one temperature in a range of 50° C. to 60° C., wherein the top layer comprises polyurethane and an ethylene acrylic acid copolymer, and the backing layer is disposed between the impression member and the top layer;

transferring an initial print separation corresponding to a color to a predetermined area of the substrate;

transferring at least one subsequent print separation corresponding to another color to the predetermined area of the substrate to form the composite image; and transporting the substrate away from the top layer of the impression member.

11. The method according to claim 10, wherein a weight ratio of the polyurethane to the ethylene acrylic acid copolymer is about 60 parts to 40 parts.

12. The method according to claim 10, wherein the transferring an initial print separation corresponding to a color on a predetermined area of the substrate further comprises:

forming a first print separation by an image forming device of the printing system;

transferring the first print separation to an image transfer blanket of an intermediate transfer member (ITM) of the printing system; and transferring the first print separation from the image transfer blanket of the ITM to the predetermined area of the substrate.

13. The method according to claim 10, wherein the transferring at least one subsequent print separation corresponding to another color to the predetermined area of the substrate to form a composite image further comprises:

forming a second print separation on an image forming device of the printing system;

transferring the second print separation to an image transfer blanket of an intermediate transfer member (ITM) of the printing system; and transferring the second print separation from the ITM to the predetermined area of the substrate.

14. A printing system to suppress misregistration between print separations on a substrate, the printing system comprising:

an image forming device to form a latent image and corresponding print separations to be printed on the substrate to form an image; and an impression member having an impression medium thereon, the impression medium including:

a backing layer disposed on the impression member, and a top layer disposed on the backing layer to receive the substrate, the top layer having a high coefficient of static friction with respect to the substrate in a range of 0.7 to 2 at at least one temperature in a range of 50° C. to 60° C., wherein the top layer comprises polyurethane and an ethylene acrylic acid copolymer.

15. The printing system according to claim 14, wherein a we ratio of the polyurethane to the ethylene acrylic acid copolymer is about 60 parts to 40 parts.

16. The printing system according to claim 14, wherein:

the backing layer comprises at least one of paper, latex saturated paper, polyethylene terephthalate, and bi-axially oriented polypropylene; and the top layer further comprises at least one of polyurethane, acrylic rubber, natural rubber, styrene butadiene rubber, silicon rubber, ethylene acrylic acid copolymer, polyethyleneimine, amine terminated polyamide, and polyvinyl pyridine.

17. The printing system according to claim 14, further comprising:

a sensor unit to detect a misalignment of the substrate with respect to the impression medium based on a color contrast between the substrate and the impression medium.

* * * * *